US006827241B2

(12) United States Patent
Bouzaglo

(10) Patent No.: US 6,827,241 B2
(45) Date of Patent: Dec. 7, 2004

(54) SEALING DEVICE FOR CONTAINER

(76) Inventor: Gabriel Bouzaglo, 6, Le Verclet, F-01100, Bellignat (FR)

( * ) Notice: Subject to any disclaimer, the term of this patent is extended or adjusted under 35 U.S.C. 154(b) by 239 days.

(21) Appl. No.: 10/169,550

(22) PCT Filed: Jan. 16, 2001

(86) PCT No.: PCT/FR01/00131

§ 371 (c)(1),
(2), (4) Date: Jul. 12, 2002

(87) PCT Pub. No.: WO01/53164

PCT Pub. Date: Jul. 26, 2001

(65) Prior Publication Data

US 2003/0071084 A1 Apr. 17, 2003

(30) Foreign Application Priority Data

Jan. 17, 2000 (FR) ..... 00 00542
Mar. 15, 2000 (FR) ..... 00 03332
Mar. 15, 2000 (FR) ..... 00 03331

(51) Int. Cl.[7] ..... B65D 25/40

(52) U.S. Cl. ..... 222/491; 222/212; 222/213; 222/494; 222/562

(58) Field of Search ..... 222/491, 492–494, 222/206, 212–213, 215, 490, 511–514, 517, 562, 92

(56) References Cited

U.S. PATENT DOCUMENTS 2,605,939 A * 8/1952 Fuchslocher ..... 222/491
3,720,523 A * 3/1973 Shizuo ..... 426/115
4,561,570 A * 12/1985 Zulauf et al. ..... 222/153.14
4,739,906 A * 4/1988 LoTurco ..... 222/212
4,789,082 A * 12/1988 Sampson ..... 222/1
5,033,655 A * 7/1991 Brown ..... 222/212
5,226,568 A * 7/1993 Newton et al. ..... 222/212
5,975,354 A * 11/1999 Goncalves ..... 222/39

FOREIGN PATENT DOCUMENTS

GB 214548 * 4/1924
GB 0172711 * 2/1986 ..... B65D/35/30
GB WO9814387 * 4/1998 ..... B65D/47/20
GB 2337980 * 12/1999 ..... B65D/81/32

* cited by examiner

*Primary Examiner*—Frederick C. Nicolas
(74) *Attorney, Agent, or Firm*—Oliff & Berridge, PLC

(57) ABSTRACT

This device comprises a diaphragm valve consisting of a part forming the valve seat, in which a duct for the flow of the product contained in the container is formed, and of a diaphragm made of elastically deformable material closely fitted onto this part.

According to the invention:

the part has a conical or cylindro-conical overall shape and has a cross section which increases toward the orifice via which the product flows out of the valve;

the diaphragm has a conical or cylindro-conical overall shape corresponding to that of the part, this shape being such that this diaphragm can be fitted closely onto or into this seat-forming part, and the diaphragm and the container comprise bearing part so as to hold the diaphragm in its position of close fitting onto or into the part.

14 Claims, 5 Drawing Sheets

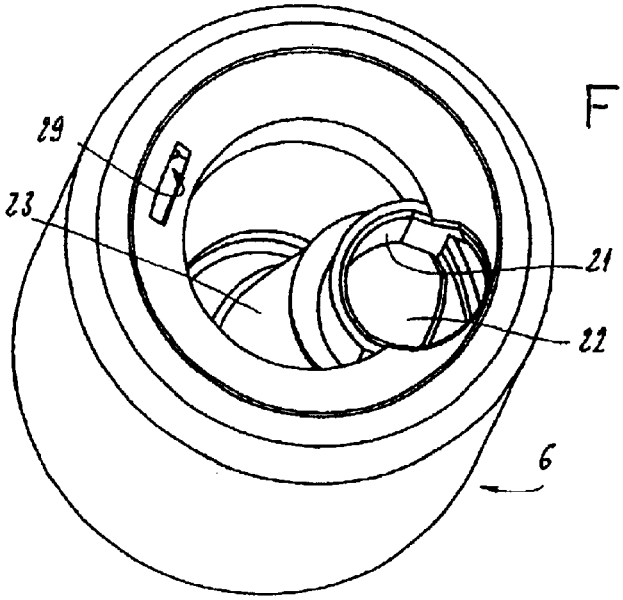
FIG 3
FIG 4
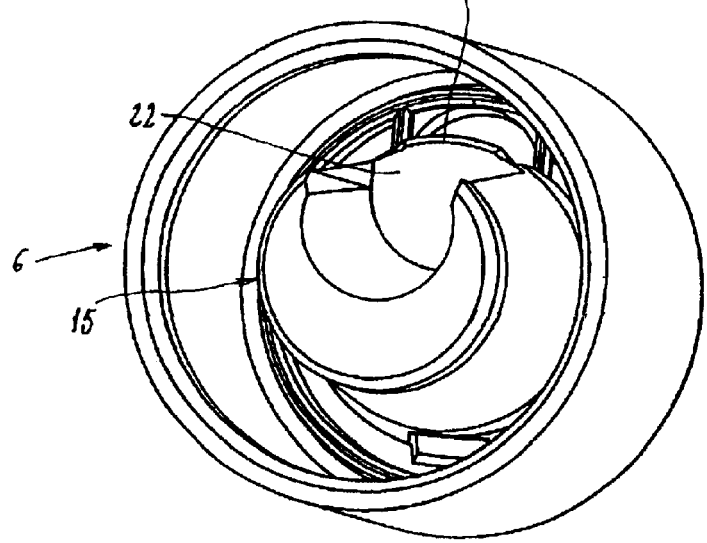
FIG 5
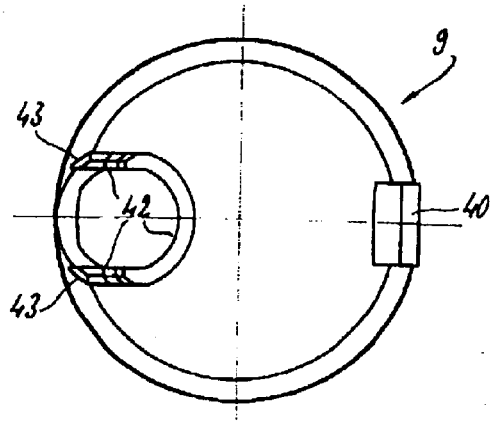

SEALING DEVICE FOR CONTAINER

BACKGROUND OF THE INVENTION

The present invention relates to a sealing device for a container, making it possible to preserve the product contained in said container from contact with the ambient air or from soiling with a foreign body originating from outside the container.

This container may in particular be a "tube", that is to say an envelope one longitudinal end of which has a neck and the other longitudinal end of which is closed by squeezing and assembling, particularly by welding, the walls of this envelope.

The product may be any product which it is important be protected against contact with the air or against dirt, particularly a cosmetic product, a food product or a product for medical use.

The invention also relates to a sealing device for a container as a structure of a container intended to contain two substances separately and to allow these substances to mix at the time of their use.

DESCRIPTION OF THE PRIOR ART

International (PCT) application No. WO 97/47531 describes a sealing device comprising a cylindrical part intended to be inserted in the neck of a container and two ducts for the flow of the product contained in this container. Said cylindrical part comprises a groove giving it the shape of a "diabolo" and is covered with an elastomer diaphragm which hugs it closely. This diaphragm, through its elastic deformation as a result of pressure on the container, allows the product to flow out between it and said cylindrical part, and is pressed against this cylindrical part in the absence of such pressure, which means that it acts like a valve.

This device is satisfactory in practice but does, however, have the disadvantage of entailing that the shapes of said cylindrical part and of said diaphragm exactly complement each other, failing which sealing is not obtained. This complementing of shapes entails recourse to overmolding techniques which are relatively complicated to implement.

In addition, it is not precluded for there to be a space between said cylindrical part and the diaphragm, in which space a quantity of product may stagnate. This quantity of product may be contaminated with air to a greater or lesser extent, and this is not desirable in the case of a cosmetic product, a food product or products for medical use. The stopper described in this same prior international application is not suitable to every type of container, and this is a certain impediment in practice.

Document GB-A-214 548 describes a sealing diaphragm which has to be stretched out to be placed over a sealing bearing surface with which it is intended to collaborate. This stretching leads to significant difficulties in the manufacture of the container.

Document WO 98/14387 describes a sealing membrane of cylindrical shape placed over a sealing bearing surface of corresponding cylindrical shape and housed thereon by means of the engagement of an annular projection secured to the diaphragm in a groove formed in said sealing bearing surface. Aside from the difficulties in fitting it, the seal obtained does not seem to be perfect.

Furthermore, an existing container generally comprises a screw-on stopper, which, although affording the product contained in the container good protection is, on the other hand, relatively difficult to manufacture and handle. Other containers have flip-up lids, which are easier to manufacture and to manipulate than screw-on stoppers but which would not perfectly protect the product contained in the container from air or dirt.

SUMMARY OF THE INVENTION

The object of the present invention is to provide a diaphragm-type sealing device of the aforementioned type which is easier to manufacture, by means of a molding technique which is relatively simple and inexpensive to perform, making it possible to obtain a perfect seal and which can be suited to any type of container, particularly those which have caps fitted onto their neck.

Another object of the invention is to effectively dispense with the risk of contamination by the ambient air or of soiling with foreign bodies, with the quantity of product that can stagnate between the product outlet orifice from the container and the diaphragm that forms the diaphragm.

The device comprises, in a way known per se, a diaphragm valve consisting of a part forming the valve seat, in which part a duct for the flow of the product contained in the container is made, and of a diaphragm made of elastically deformable material fitted closely over this seat-forming part; this diaphragm, through elastic deformation, the result of pressure exerted on the product contained in the container allows this product to flow out between it and the seat-forming part, and in the absence of such pressure, presses against this seat-forming part to shut off the flow of product and close the container in a sealed manner.

According to the invention,

- said seat-forming part has a conical or cylindro-conical overall shape and has a cross section which increases toward the orifice via which the product flows out of said valve;
- said diaphragm has a conical or cylindro-conical overall shape corresponding to that of said seat-forming part, this shape being such that this diaphragm can be fitted closely onto or into this seat-forming part, and
- said diaphragm and said container comprise respective bearing means collaborating with one another when the sealing device is mounted on the container so as to hold the diaphragm in its position of close fitting onto or into said seat-forming part.

Thus, according to the invention, said seat-forming part and said diaphragm can be produced independently of one another then assembled together by push-fitting to constitute the sealing device; said bearing means of the diaphragm with respect to the container therefore allow the diaphragm to be immobilized axially with respect to the seat-forming part.

This seat-forming part and this diaphragm can therefore be manufactured using molding techniques which are relatively conventional and simple to operate, and the sealing device according to the invention is no longer, as it was in the prior art, dependent on a close fitting engagement into the neck of the bottle.

The seat-forming part and the diaphragm are advantageously shaped to allow the diaphragm to be stretched out circumferentially slightly over the seat-forming part or to allow this diaphragm to be contracted circumferentially slightly in the seat-forming part, in said position of close fitting.

This circumferential stretching or this circumferential shrinking make it possible to absorb any respective dimensional variations in the seat-forming part and in the diaphragm as a result of the tolerances on the manufacture thereof.

Said bearing means may advantageously extend over the entire circumference of the diaphragm and be shaped to be able to constitute a seal between the part of the container forming the product reservoir and the neck of the container and/or between this neck and a part such as a cap that the end of the container may take.

According to a preferred embodiment of the invention, the seat-forming part is molded with a part, particularly a cap, intended to be mounted, for example by snap-fastening, on the neck of the container.

Advantageously, in this case, the diaphragm comprises a bulge which, when said part is fitted onto the container, bears against a bearing surface formed in the neck of the container, and/or the diaphragm has a collar projecting radially outward and shaped so that, when said part is fitted onto the container, it is gripped between the neck and this part.

Advantageously, the seat-forming part has a rib projecting from its wall, radially and toward the outside thereof, this rib being situated between the duct via which the product can be introduced between the seat-forming part and the diaphragm and the duct via which this product escapes from between this seat-forming part and this diaphragm toward the outlet orifice, the two orifices of these ducts situated closest to each other being formed near this rib.

Said rib thus collaborates with the diaphragm to form a linear seal that markedly separates the region between these two orifices and this region is reduced to a minimum. This seal acts as an effective barrier against the ingress of a foreign body, and there is practically no product that can stagnate between said orifices and can therefore become contaminated with ambient air.

As a preference, the sealing device comprises a flip-up lid shaped to be normally returned to the closed position and to pivot to the open position only under the pressure of the stream of product.

This lid completes the sealing of the container, particularly allows the quantity of product immediately to the rear of the product outlet orifice to be ensured of complete protection.

Advantageously, in this case, the lid comprises a tab shaped to, in the closed position of this lid, bear against a thickened part of the diaphragm and, when the lid is pivoted into the open position, to deform this thickened part elastically so that the latter, by elastic return, tends to return the lid to the closed position.

This thickened part may in particular belong to the aforementioned bearing means.

Said tab may comprise a catch engaging with a corresponding rim, so as to allow the lid to be mounted, the coming of this tab against said thickened part of the diaphragm holding this catch against this rim.

The lid may also comprise at least one deformable part molded integrally with it, and which is shaped to deform when the lid is brought into the open position and to tend, by elastic return, normally to return this lid to the closed position.

According to another aspect of the invention, the device comprises a cap which delimits a flow duct for the product and a lid received in pivoting on the cap to allow the duct to be closed; the cap has a hole and comprises a part made of elastic material situated inside it, facing this hole; the lid comprises a tab sized to be engaged in this hole with the possibility of clearance, this clearance allowing said lid to move between its open and closed positions; the tab further comprises a rib which can be snap-fitted behind an edge of the lid delimiting said hole, so as to allow the lid to be mounted on the cap; the assembly is shaped in such a way that when said rib is snap-fastened behind said edge, the tab deforms said elastic part so that the elastic return of this part allows the lid to be kept in its closed position and without the flexibility of this part impeding the pivoting of this lid into the open position under the pressure of the product contained in the container.

The lid is thus normally kept in the closed position, and pivots into the open position only to allow product contained in the container to flow out. This results in perfect protection of this product, and the device remains simple and easy to manufacture and easy to assemble.

As a preference, the lid comprises, on the opposite side to said tab, at least one deformable part molded integrally with it, while the cap comprises at least one corresponding wall against which this deformable part can slide when the lid is brought into the open position; said corresponding wall makes it possible to deform said deformable part in such a way that this deformation tends, by elastic return of the material of the lid, to return this lid to the closed position.

Advantageously, the cap comprises a recess for accommodating the lid in the closed position, this recess having dimensions which correspond to those of the lid and being shaped in such a way that the exterior face of the lid is in the continuation of the exterior face of the cap when the lid is in place in said recess, in the closed position.

The lid therefore offers no external grip which might allow it to be lifted. The product is thereby protected all the more vigorously.

The lid advantageously, on its exterior side and facing said tab, has a region shaped so as not to correspond precisely to the shape of the corresponding region of the cap with which engages when the lid is mounted on the cap.

The result of this is that the lid is slightly deformed elastically when the tab is engaged in said hole in the cap and that this deformation continues to normally keep the lid in its closed position.

BRIEF DESCRIPTION OF THE DRAWINGS

For its clear understanding, the invention is once again described hereinbelow with reference to the attached schematic drawings which, by way of nonlimiting example, depict one preferred embodiment of the sealing device to which it relates.

FIG. 3 is a perspective view of the cap from the outside;

FIG. 4 is a perspective view of the cap from the inside;

FIG. 5 is a flat view of the lid, via the interior face thereof;

DESCRIPTION OF THE PREFERRED EMBODIMENTS

Figure 1:
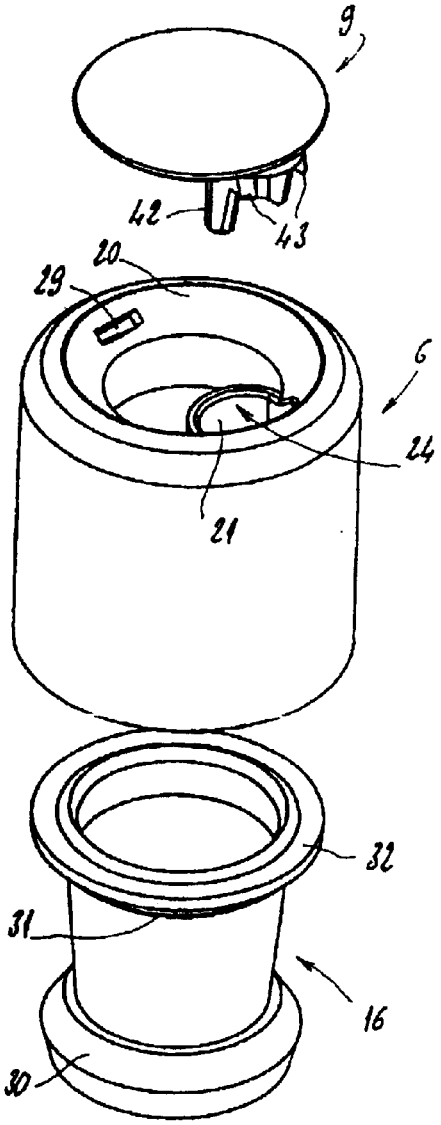
FIG. 1 is a perspective view of a cap equipped with it, the diaphragm it comprises, and of a lid which closes the opening of the cap.
Figure 2:
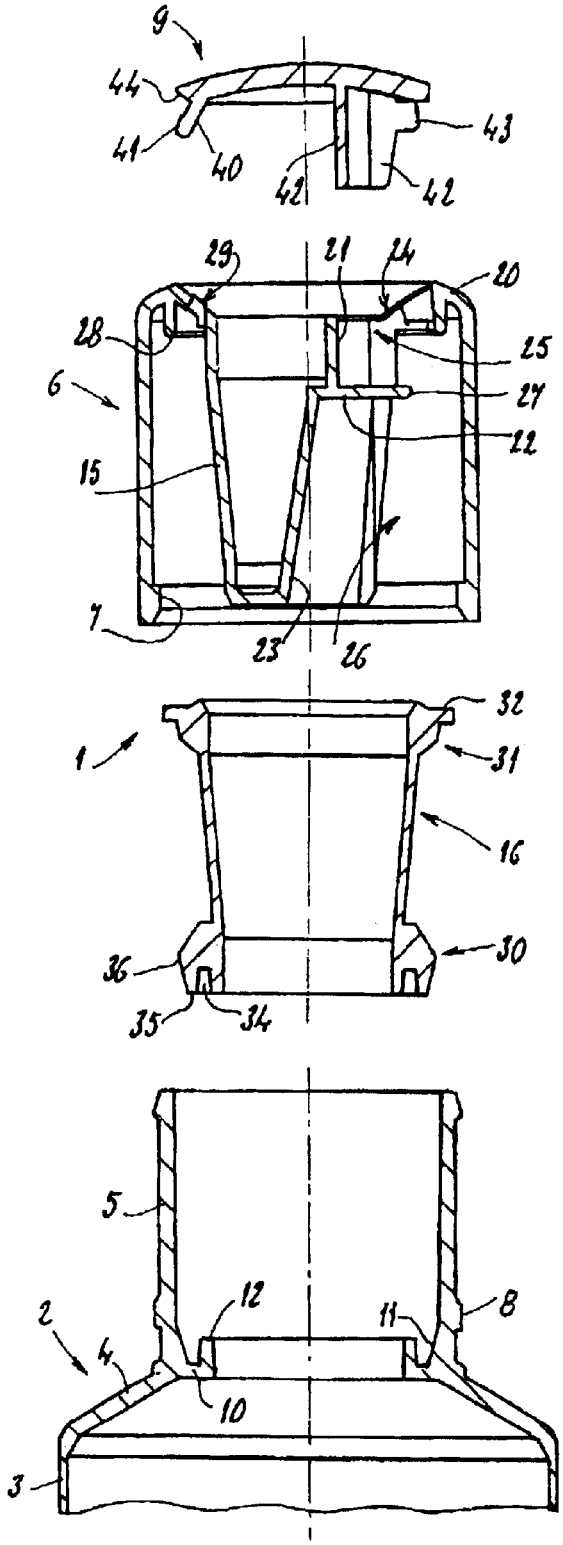
FIG. 2 is a view in section along its axis, and of said cap and lid, this figure also showing the end of a container on which the cap is intended to be snap-fastened.

FIGS. 1 to 7 depict a sealing device 1 for a container 2, allowing the product contained in this container 2 to be preserved in contact with the ambient air or from soiling with a foreign body from outside the container 2.

This container may in particular be a "tube", that is to say an envelope 3 one longitudinal end of which has a circular transverse wall 4 and a neck 5, and the other longitudinal end (not visible in the figures) of which is closed by squeezing together and assembling the walls of this envelope 3.

In the example depicted, this container 2 comprises a cap 6 able to accommodate the neck 5 and to be snap-fitted onto the latter, through the collaboration of respective annular projections 7, 8, and a lid 9 for closing this cap 6.

Furthermore, the container 2 comprises an internal flange 10 projecting from its wall at the base of the neck 5, surmounted by a conical bearing surface 11. The flange 10 comprises a circular wall 12 projecting upward.

The device 1 comprises a diaphragm valve consisting of a block 15 forming the seat of this valve and a diaphragm 16 made of an elastically deformable material, fitted closely over this block 15.

The block 15 is secured to the end wall 20 of the cap 6. It has an upper curved wall 21, an intermediate transverse web 22 and a lower curved wall 23. The wall 21 delimits, with the wall 20, an outlet orifice 24 for the product contained in the container 2 and, with the web 22, an upper duct 25 for the flow of this product; the wall 23 delimits, with the web 22, a lower duct 26 for the flow of this same product.

The block 15 also has a rib 27 projecting from its wall, radially and toward the outside thereof, at the web 22. This rib 27 extends over a same angular portion of the block 15 as the duct 26 and thus separates the upper orifice of this duct 26 from the lower orifice of the duct 25.

This block 15 has a conical overall shape and a cross section which increases toward the orifice 24.

The cap 6 also has a circular wall 28 and a hole 29 situated on the side diametrically opposite the orifice 24. The wall 28 projects from the interior face of the wall 20, and its inside face has a slight inclination with respect to the axis of the cap 6.

The diaphragm 16 is molded from an elastically deformable material. It has a generally conical tubular shape corresponding to the exterior shape of the block 15. This shape is such that the diaphragm 16 can be fitted closely onto the block 15, being stretched out slightly in the circumferential direction.

Figure 6:
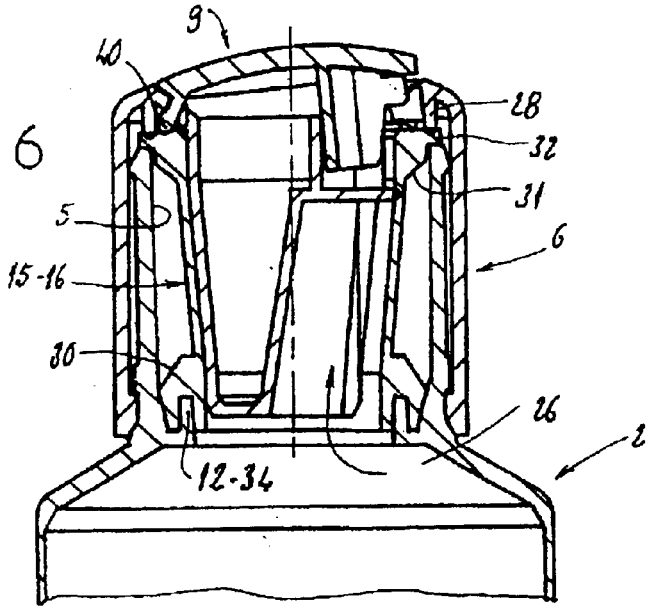
FIG. 6 is a view similar to FIG. 2, after assembly when the product contained in the container is in a position to flow out.
Figure 7:
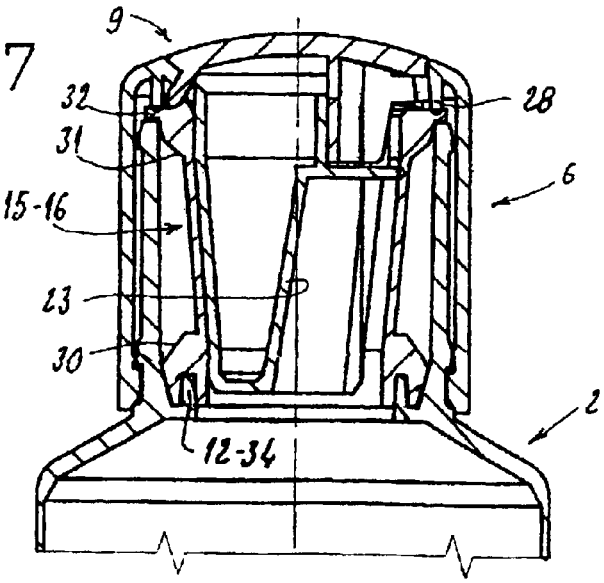
FIG. 7 is a view similar to FIG. 6, with the container in the sealed closed position.
Figure 10:
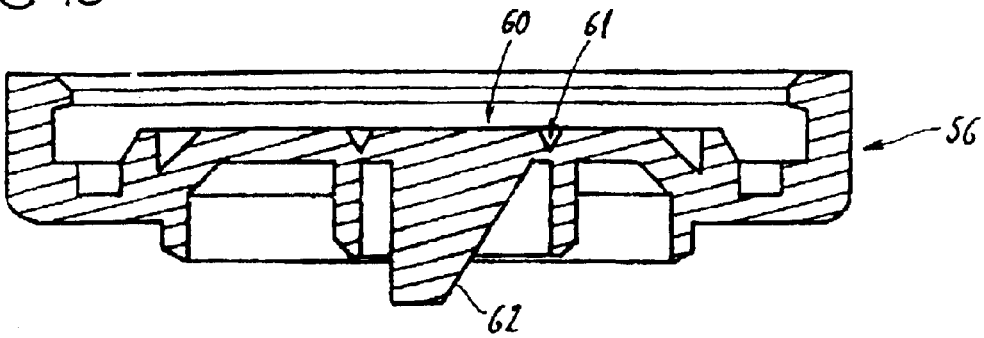
FIG. 10 is a cross-sectional view of an embodiment of a part 56 as shown in FIG. 8.

The diaphragm 16 comprises a bulge 30 at its smaller cross-section end and a bulge 31 extended by a collar 32 at its larger cross section end. The bulge 30 has a circular slot 34 opening into the axial end face 35, and an inclined lateral face 36. The slot 34 has a width smaller than the width of the wall 12 and is intended to house this wall 12 when the cap 6, the diaphragm 16 and the container 2 are being assembled. This accommodation causes outward radial deformation of the bulge 30, ensuring the perfect sealing of the assembly. The faces 35 and 36 bear respectively against the flange 10 and the bearing surface 11, as can be seen in FIGS. 6 and 7. The collar 32 projects radially outward and is shaped to be, when the cap 6 is put in place on the container 2, gripped between the neck 5 and the wall 28 of the cap 6.

The lid 9 has a tab 40 comprising a catch 41, walls 42 able to engage in the duct 25 to guide the pivoting of the lid 9, and inclined faces 43 able to bear against the internal face of the wall 28.

As shown more particularly in FIGS. 6 and 7, this tab 40 is intended to be engaged in the hole 29 and to bear against the bulge 31, digging slightly into it.

This digging-in allows the catch 41 to be kept in engagement with the corresponding edge of the cap 6 which delimits the hole 29.

The region 44 of the lid 9 situated facing the tab 40 is shaped so as not to correspond precisely to the shape of the region of the wall 20 with which it engages, so that the lid 9 is deformed elastically slightly when said tab 40 is engaged in the hole 29 and so that this deformation tends normally to keep the lid 9 in its closed position and so that this lid 9 pivots into the open position only under the pressure of the stream of product.

The aforementioned digging-in of the tab 40 into the bulge 31 allows the elastic deformation of this bulge 31 under the movement of the lid 9 to the open position which tends, by elastic return, to return the lid to the closed position.

The faces 43 slide against the interior face of the wall 28 during this same movement of the lid 9 into the open position, but are shaped to deform the walls 42 and the lid 9 slightly in this same position, thus contributing to returning the lid 9 to the closed position.

In practice, the lid 6—block 15 assembly, on the one hand, and the diaphragm 16 on the other hand, can be produced independently then assembled by pushing them together in order to form the sealing device 1.

The circumferential stretching of the diaphragm 6, and the rib 27, makes it possible to absorb any respective variations in dimensions of the block 15 and of the diaphragm 16.

After mounting, the bulges 30 and 31, the collar 32, the flange 10, the bearing surface 11, the neck 5 and the wall 28 constitute bearing means collaborating with one another to hold the diaphragm 16 in its position of being fitted closely onto the block 15. These same means make it possible to form two seals to seal the container 2. These seals are particularly effective given that the bearing surface 11 and the wall 28 tend to press the bulges 30 and 31 respectively radially and inward.

Pressure exerted on the container 2 causes the product contained in the container to flow into the duct 26 as far as the web 22 and the rib 27. The latter collaborates with the diaphragm 16 to form a linear seal that markedly separates the region between the upper orifice of the duct 26 and the lower orifice of the duct 25. This seal forms an effective barrier against the ingress of any foreign body into the container 2. In addition, said region is reduced to the minimum and there is practically no product that can stagnate between said orifices.

The lid 9 makes it possible to have perfect protection of the quantity of product situated immediately behind the orifice 24.

Figure 8:
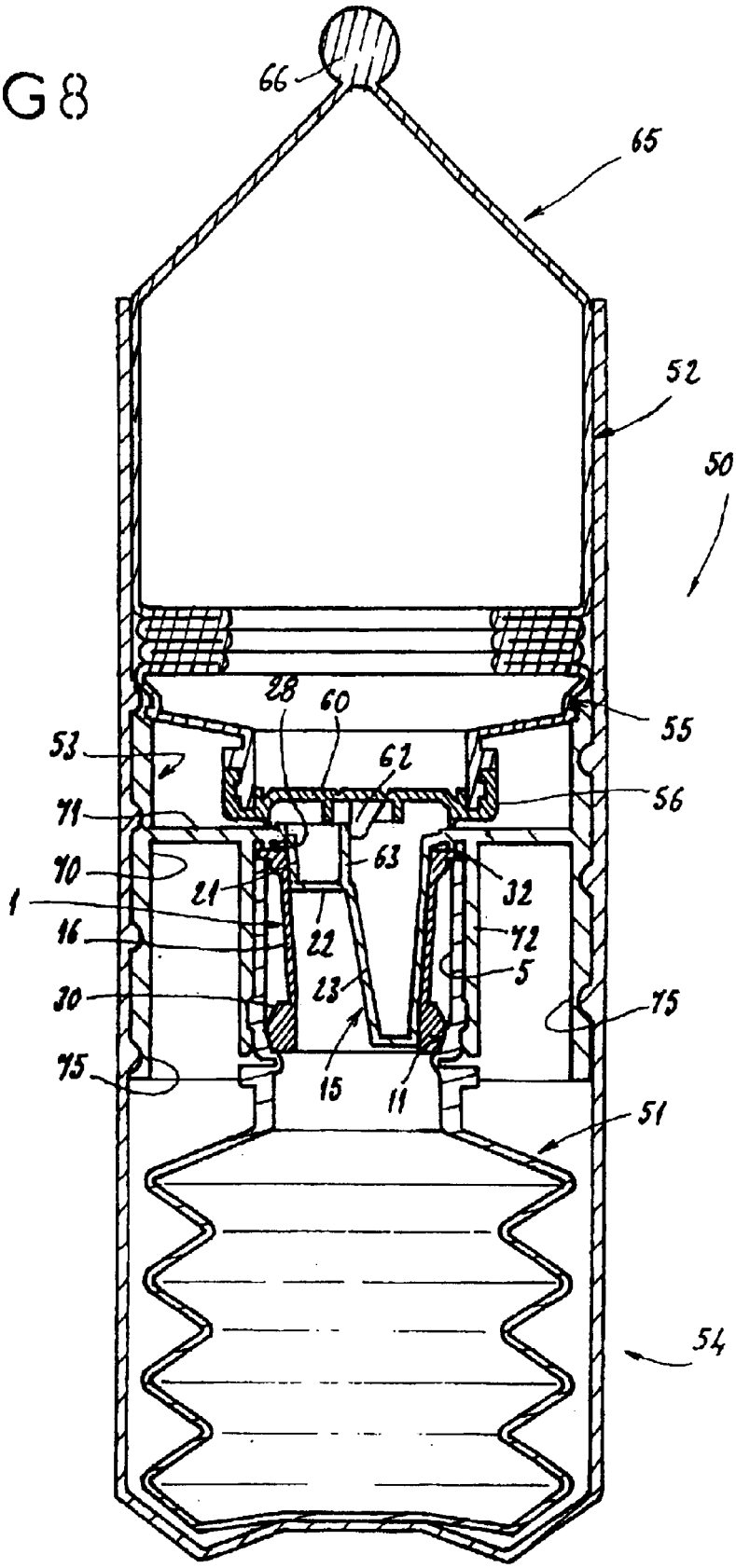
FIG. 8 is a perspective view, with longitudinal section, of another container equipped with said sealing device, prior to assembly.
Figure 9:
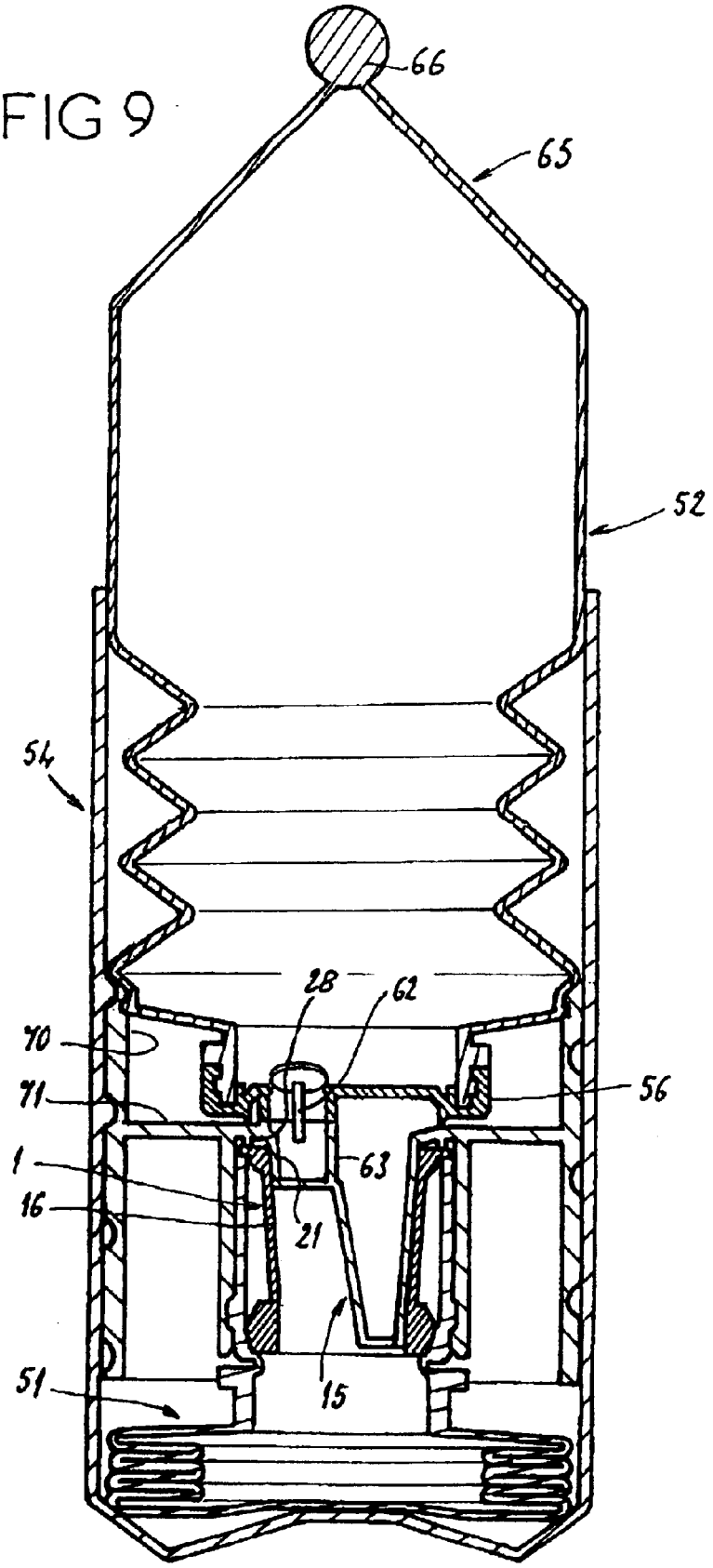
FIG. 9 is a view of the container similar to FIG. 8 after assembly.

FIGS. 8 and 9 show another container 2 equipped with a device 1 similar to the one described hereinabove. For simplification, the same reference numerals as before are used to denote means which have already been described and which will not be described again.

In this case, the block 15 forms a seat at its internal wall, of cylindro-conical configuration.

At one end, the block 15 forms a collar 50 of a diameter greater than the internal diameter of the neck 5, able to bear against the internal edge 10 of this neck 5, and has a cavity 51 for the purchase of a tool for fitting the block 15—diaphragm 16 assembly in place in the neck 5, from inside the container 2, as shown in FIG. 9.

At its other end, the block 15 comprises a collar 52 projecting radially outward, of a diameter slightly smaller than the inside diameter of the neck 5 and situated slightly set back from the end edge of this block 15.

The diaphragm 16 is engaged closely in this block 15, with slight circumferential contraction. It has an aperture 55 through which the product can flow and, at its end at the end from which the product leaves the container 2, has a turned-down edge 56. This edge 56 comes into engagement around the corresponding edge of the block 15, bearing against the collar 52.

At this edge 56, the diaphragm 16 has a diameter slightly greater than the inside diameter of the neck 5 and a step such that when the block 15—diaphragm 16 assembly is engaged in the neck 5 from inside the container 2, this edge 56 clips beyond the external edge of the neck 5. In this position of snap-fitting, the collar 50 presses closely against the internal edge 10 of the neck 5.

FIGS. 8 and 9 thus show one embodiment of the invention allowing the fitting of said block 15—diaphragm 16 assembly from inside the container 2.

As is apparent from the foregoing description, the invention provides a sealing device which exhibits numerous advantages over the similar devices of the prior art, particularly those of being easy to manufacture, using relatively uncomplicated molding techniques which are relatively inexpensive to implement, making it possible to obtain a perfect seal, and being adaptable to suit any type of container.

It goes without saying that the invention is not restricted to the embodiment described hereinabove by way of example but that on the contrary it encompasses all alternative forms of embodiment thereof.

What is claimed is:

1. A sealing device for a container comprising a diaphragm valve consisting of a seat-forming part forming a valve seat part forming the valve seat, in which said seat-forming part a duct for flow of a product contained in the container is made, and of a diaphragm made of elastically deformable material fitted closely over said seat-forming part; said diaphragm, through elastic deformation, a result of pressure exerted on the product contained in the container allows said product to flow out between the diaphragm and said seat-forming part, and in the absence of such pressure, presses against said seat-forming part to shut off the flow of product and close the container in a sealed manner;

wherein:

said seat-forming part has a conical or cylindro-conical overall shape and has a cross section which increases toward the a first orifice via which the product flows out of said valve;

said diaphragm has a conical or cylindro-conical overall shape corresponding to that of said seat-forming part, said shape being such that said diaphragm can be fitted closely onto or into said seat-forming part, and said diaphragm and said container comprise respective bearing means collaborating with one another when the sealing device is mounted on the container so as to hold the diaphragm in its position of close fitting onto or into said seat-forming part.

2. The device as claimed in claim 1, wherein the seat-forming part and the diaphragm are shaped to allow the diaphragm to be stretched out circumferentially slightly over the seat-forming part or to allow this diaphragm to be contracted circumferentially slightly in the seat-forming part, in said position of close fitting.

3. The device as claimed in claim 1, wherein said bearing means extend over the entire circumference of the diaphragm and are shaped to be able to constitute a seal between the part of the container forming the product reservoir and the neck of the container and/or between said neck and an element that the end of the container may take.

4. The device as claimed in claim 1, wherein the seat-forming part is molded with an element, intended to be mounted, on the neck of the container.

5. The device as claimed in claim 4, wherein:

the diaphragm comprises a bulge which, when said element is fitted onto the container, bears against a bearing surface formed in the neck of the container, and/or the diaphragm has a collar projecting radially outward and shaped so that, when said element is fitted onto the container, it is gripped between the neck and said element.

6. The device as claimed in claim 1, wherein the seat-forming part has a rib projecting from its wall, radially and toward the outside thereof, said rib being situated between a second orifice via which the product can be introduced between the seat-forming part and the diaphragm and the first orifice via which said product escapes from between said seat-forming part and said diaphragm, each of said orifices being formed near said rib.

7. The device as claimed in claim 1, and which comprises a flip-up lid shaped to be normally returned to a closed position and to pivot to a open position only under the pressure of the stream of product.

8. The device as claimed in claim 7, wherein the lid comprises a tab shaped to, in the closed position of this lid, bear against a thickened part of the diaphragm and, when the lid is pivoted into the open position, to deform this thickened part elastically so that the latter, by elastic return, tends to return the lid to the closed position.

9. The device as claimed in claim 8, wherein said tab comprises a catch engaging with a corresponding rim, so as to allow the lid to be mounted, the coming of said tab against said thickened part of the diaphragm holding said catch against said rim.

10. The device as claimed in claim 8, wherein the lid comprises at least one deformable part molded integrally with the lid, and which is shaped to deform when the lid is brought into the open position and to tend, by elastic return, normally to return said lid to the closed position.

11. The device as claimed in claim 1, comprising a cap which delimits a flow duct for the product contained in the container, and a lid received in pivoting on the cap to allow the duct to be closed, wherein:

the cap has a hole and comprises a part made of elastic material situated inside it, facing said hole;

the lid comprises a tab sized to be engaged in said hole with a possibility of clearance, said clearance allowing said lid to move between its open and closed positions; the tab further comprises a rib which can be snap-fitted behind an edge of the lid delimiting said hole, so as to allow the lid to be mounted on the cap;

the device is shaped in such a way that when said rib is snap-fastened behind said edge, the tab deforms said elastic part so that the elastic return of said part allows the lid to be kept in its closed position and without flexibility of said part impeding pivoting of said lid into the open position under the pressure of the product contained in the container.

12. The device as claimed in claim 11, wherein the lid comprises, on the opposite side to said tab, at least one deformable part molded integrally with the lid, while the cap comprises at least one corresponding wall against which said deformable part can slide when the lid is brought into the open position; said corresponding wall makes it possible to deform said deformable part in such a way that deformation tends, by elastic return of the material of the lid, to return said lid to the closed position.

13. The device as claimed in claim 11, wherein the cap comprises a recess for accommodating the lid in the closed position, said recess having dimensions which correspond to those of the lid and being shaped in such a way that the exterior face of the lid is in continuation of the exterior face of the cap when the lid is in place in said recess, in the closed position.

14. The device as claimed in claim 11, wherein the lid, on its exterior side and facing said tab, has a region shaped so as not to correspond precisely to the shape of the corresponding region of the cap with which engages when the lid is mounted on the cap.

* * * * *